US006648051B1

(12) United States Patent
Young

(10) Patent No.: US 6,648,051 B1
(45) Date of Patent: Nov. 18, 2003

(54) FOLDABLE DRY ERASE SURFACE

(75) Inventor: Randy S. Young, Lilburn, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/950,896

(22) Filed: Sep. 10, 2001

(51) Int. Cl.[7] ..... E05D 15/26

(52) U.S. Cl. ..... 160/199; 160/135; 160/231.1; 402/73; 402/80 R

(58) Field of Search ..... 160/199, 135, 160/230, 231.1, 231.2; 402/73, 80 R; 434/416, 412, 421; 52/36.1, 529.1; 428/195

(56) References Cited

U.S. PATENT DOCUMENTS

| | | | | | |
|---|---|---|---|---|---|
| 3,817,396 | A | * | 6/1974 | Markson | 211/178 R |
| 3,938,772 | A | * | 2/1976 | Andrusiak | 248/461 |
| 4,802,967 | A | * | 2/1989 | Kittler | 204/192.14 |
| 4,828,502 | A | * | 5/1989 | Leahy | 434/416 |
| 4,830,899 | A | * | 5/1989 | Nakahashi et al. | 428/137 |
| 4,929,110 | A | * | 5/1990 | Berg et al. | 402/73 |
| 4,961,454 | A | * | 10/1990 | Reilly, Jr. et al. | 160/344 |
| 5,024,898 | A | * | 6/1991 | Pitts et al. | 428/511 |
| 5,207,581 | A | * | 5/1993 | Boyd | 434/412 |
| 5,301,477 | A | * | 4/1994 | Relinger et al. | 52/36 |
| 5,367,350 | A | * | 11/1994 | Winfrey | 353/120 |
| 5,515,900 | A | * | 5/1996 | West et al. | 160/135 |
| 5,915,445 | A | * | 6/1999 | Rauenbusch | 160/230 |
| 5,987,825 | A | * | 11/1999 | Rosen | 52/36.1 |
| 6,065,253 | A | * | 5/2000 | Ojeda | 52/79.9 |
| 6,155,689 | A | * | 12/2000 | Smith | 359/530 |
| 6,191,353 | B1 | * | 2/2001 | Shiotsuka et al. | 136/256 |
| 6,251,500 | B1 | * | 6/2001 | Varga et al. | 428/195 |
| 6,258,666 | B1 | * | 7/2001 | Mizutani | 438/258 |
| 6,403,188 | B1 | * | 6/2002 | Donahue | 428/40.1 |
| 2001/0024720 | A1 | * | 9/2001 | Sweet et al. | 428/343 |
| 2001/0040207 | A1 | * | 11/2001 | Richardson | 248/460 |

OTHER PUBLICATIONS

My Whiteboards.com; An OptiMA, Inc. Company, Westborough, MA "Poly Rite Dry Erase Wallpapaer"; www.mywhiteboards.com.

Welcome to Boardbase, Inc.; Boardbase, Inc.—Zephyr Cover, Neveda; www.boardhouse.com.

* cited by examiner

*Primary Examiner*—Bruce A. Lev
(74) *Attorney, Agent, or Firm*—Merchant & Gould

(57) ABSTRACT

A foldable dry erase surface, such as a temporary wall, permits writing on the surface as is typically done with a dry erase board. The dry erase surface includes individual panels that are hinged together so that the surface formed by the panels is foldable. The individual panels have a dry erase film attached to them so that writing may occur on the panels themselves. The dry erase surface may be collapsed when not in use, or it may be expanded when it is necessary to write on or read from the surface. The dry erase surface is collapsed or expanded by pivoting the panels about the hinged connections, which is typically done by pushing or pulling an end panel of the dry erase surface.

29 Claims, 2 Drawing Sheets

FOLDABLE DRY ERASE SURFACE

TECHNICAL FIELD

The present invention relates to dry erase surfaces that allow writing to be easily removed. More specifically, the present invention relates to foldable dry erase surfaces that can be collapsed or expanded.

BACKGROUND

A dry erase board is a convenient tool that allows a user to write on the board with a marker and then erase the board with a dry eraser. The dry erase board is considered an improvement over a chalkboard because it produces no chalk dust and is generally easier to write on. The dry erase board comes in various forms, such as a board that may be mounted on a fixed wall, a board that is supported by an easel, or dry erase wallpaper adhered to a fixed wall.

It is convenient to have a dry erase board mounted to a fixed wall or have dry erase wallpaper on a fixed wall so that the dry erase board is always available in a given room. However, foldable walls are often employed to create flexible room configurations, and a fixed wall may be unavailable for the room configurations as a result. For example, it is possible to create temporary rectangular rooms using four foldable walls. In such a case, it may continue to be desirable to have convenient access to a dry erase board, but no fixed walls exist to support it.

Therefore, there is a need in the art for a foldable dry erase board, such as a foldable dry erase board that serves as a temporary wall for a particular room configuration.

SUMMARY

Embodiments of the present invention provide a foldable dry erase surface. The foldable surface has several panels that are contiguously connected together through hinged connections that allow the panels to pivot and thereby fold together to collapse the surface. The hinged connection may be integral to the panels or may be a distinct hinge that is attached between them. A dry erase film is applied to one or more panels to form the foldable dry erase surface.

The dry erase surface may be hung from a ceiling surface to form a wall. For example, the dry erase surface may have hangers attached to the panels with the hangers movably engaging a ceiling mounted track. The dry erase surface may then be expanded and collapsed as necessary to provide or remove a temporary wall. Users can write on the dry erase wall with dry erase markers and can erase the writing with dry erasers.

The various aspects of the present invention may be more clearly understood and appreciated from a review of the following detailed description of the disclosed embodiments and by reference to the drawings and claims.

DETAILED DESCRIPTION

Figure 1:
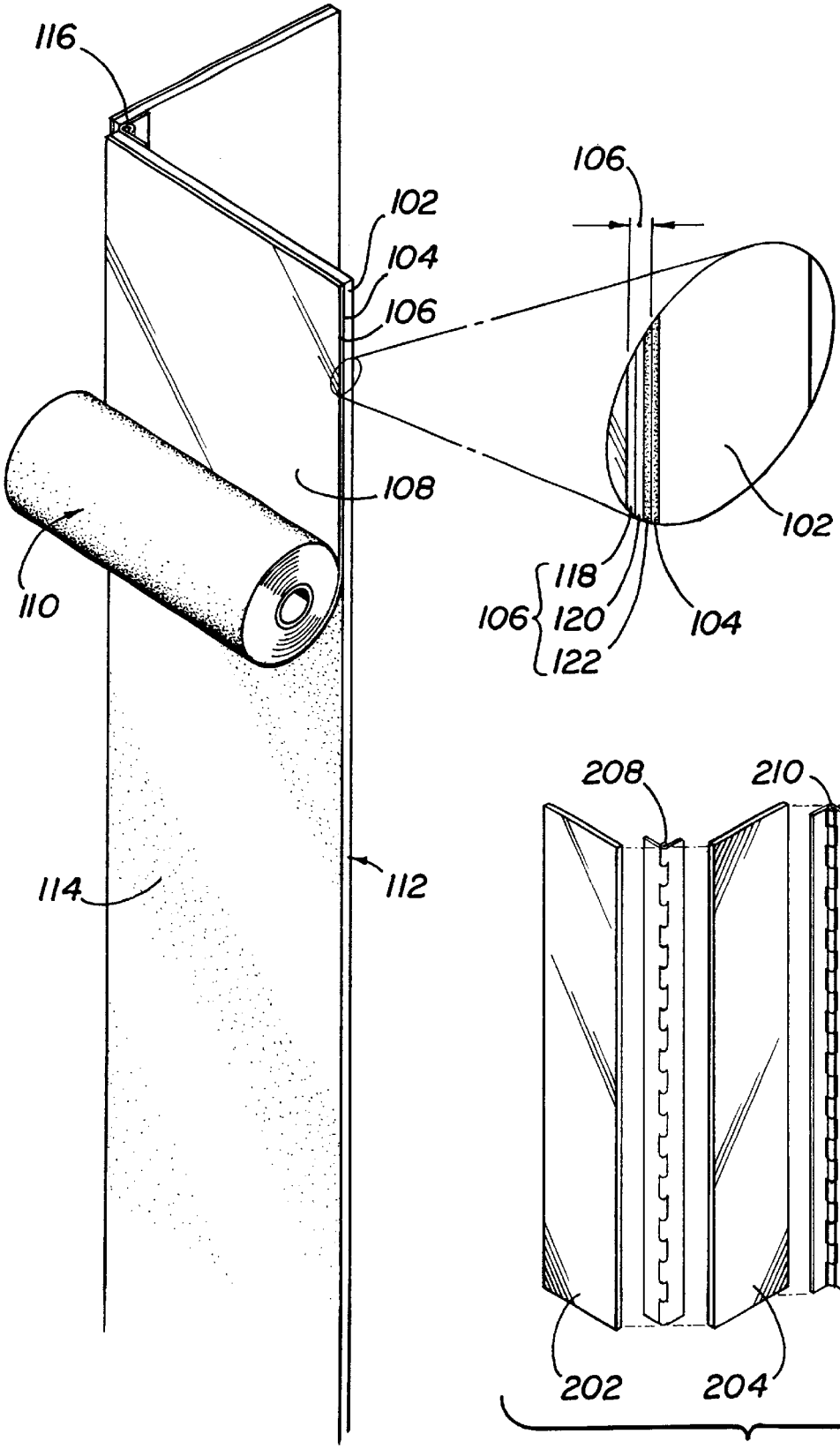
FIG. 1 illustrates the application of dry erase film to panels of a foldable surface.

FIG. 1 shows a panel 112 of a foldable surface. The panel 112 is being covered with a roll 110 of dry erase film 108. The panel 112 may be made of various materials such as plastic or wood and has a hinged connection 116 to adjacent panels. The dry erase film 108 is fixed to the panel 112 with an adhesive 114. The dry erase film 108 when applied to the panel 112 creates a dry erase surface suitable for writing and erasing. The dry erase surface includes a panel layer 102, an adhesive layer 104, and a dry erase film layer 106. An additional adhesive layer 104 and dry erase layer 106 may be also be applied to the other side of panel 112 so that writing may occur on both sides.

The dry erase film layer 106 is commercially available and may be composed of sub-layers including a top layer 118 of ethylene/tetrafluoroethylene copolymer film on a middle layer 120 of a polyvinyl chloride sheet. The bottom layer 122 contacting the adhesive layer 104 may include a polyester cloth backing. Additives may be included in the dry erase film, so as to give the dry erase film a particular color and/or other qualities such as magnetic characteristics. While the layer 106 of dry erase film 108 is shown as being applied from a roll 110, it is to be understood that the film 108 may be applied to the panel 112 in other ways, such as using pre-cut sheets of film 108 sized to fit the panel 112.

Figure 2:
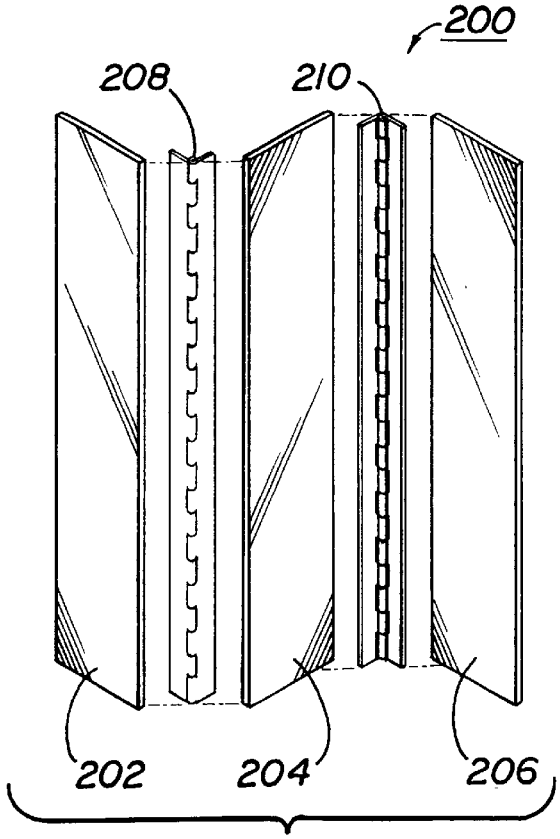
FIG. 2 shows the assembly of panels and a non-integral hinge of a foldable dry erase surface.

FIG. 2 shows the panels 202, 204, 206 of a foldable dry erase surface 200 having non-integral hinges 208, 210 applied so as to provide a hinged connection between adjacent panels. Distinct, non-integral hinges may be used where the panels do not have an integral hinged connection, such as where wooden panels are used. Alternatively, the hinged connection may be integral to the panels, such as where the panels are plastic and the hinged connections are weakened portions of plastic separating adjacent rigid panels of a continuous sheet. The dry erase film 108 of FIG. 1 may be applied to the panels 202, 204, and 206 before or after the hinges 208, 210 are installed.

Figure 3:
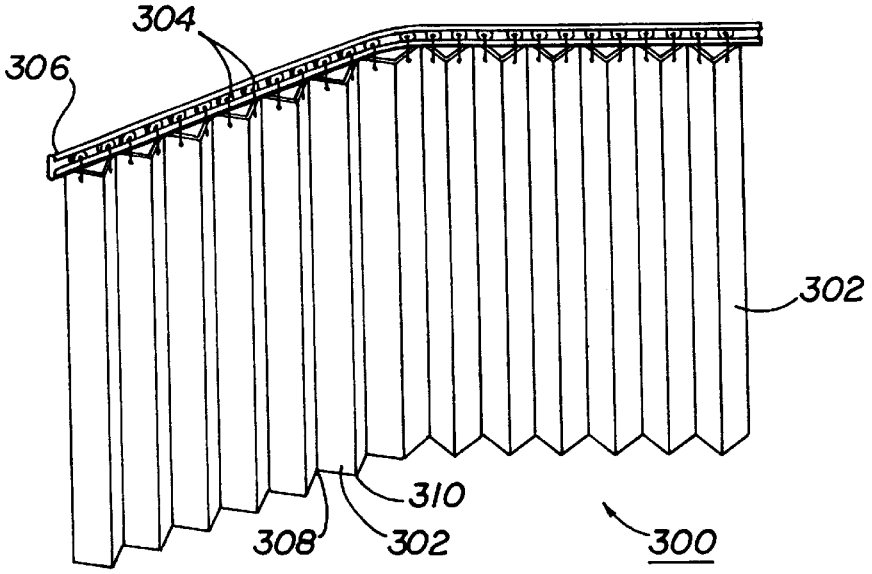
FIG. 3 shows the mounting of a foldable dry erase surface to a ceiling mounted track to create a foldable wall.

A foldable dry erase wall 300 is shown in FIG. 3. The foldable dry erase wall 300 includes contiguous panels where each adjacent panel 302 has a hinged connection 308, 310. The dry erase wall 300 may include a track 306 and a guide structure for guiding the panels along the track 306 as the wall 300 is expanded or collapsed. The guide structure may include hangers 304 that are fixed to the panels 302 and movably engage the track 306. The track 306 may be ceiling mounted so that the panels hang from the ceiling. The track 306 and hangers 304 allow the foldable wall 300 to be expanded or collapsed, as shown in greater detail in FIGS. 4 and 5, respectively.

Figure 4:
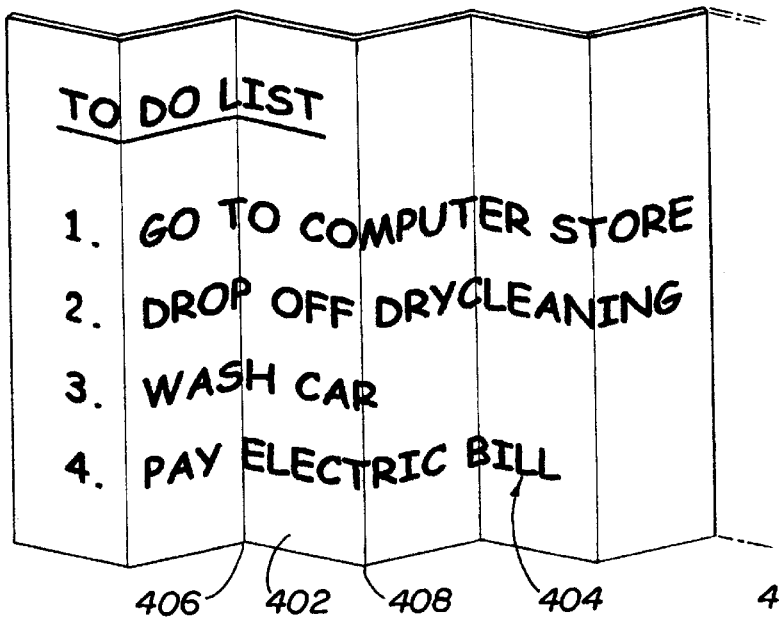
FIG. 4 shows a foldable dry erase surface in an expanded state with writing included thereon.
Figure 5:
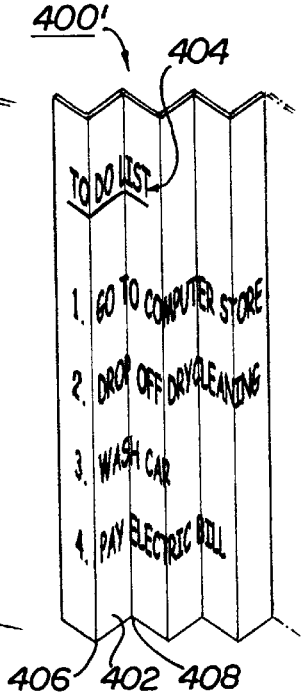
FIG. 5 shows the foldable dry erase surface of FIG. 4 in a collapsed state.

The foldable dry erase wall 300 may be used where temporary walls are desirable, so as to temporarily break one large room into two or more smaller rooms. Because the panels 302 have a dry erase surface, markers can be used to write on the walls (as shown in FIGS. 4 and 5), and dry erasers can be used to easily remove the writing from the walls. When the walls are to be written to or read from, they may be expanded and afterwards they may be collapsed.

FIG. 4 shows a foldable dry erase surface 400 in an expanded state. The adjacent panels 402 of the surface 400 contain writing 404 that results from the use of a dry erase marker. Generally, the panels are expanded so that each panel 402 forms an angle greater than 90 degrees with the next adjacent panel when a user wishes to write to or read from the surface 400. Ideally, the panels are fully expanded by pivoting the panels 402 about the hinged connections 406, 408 so that each panel 402 forms an angle of 180 degrees with each adjacent panel to cause the surface 400 to form a single plane.

FIG. 5 shows a foldable dry erase surface 400' in a collapsed state. The adjacent panels 402 of the surface 400' continue to display the writing 404 previously written to the surface 400'. As the surface 400' collapses, each panel 402 forms an angle less than 90 degrees with each adjacent panel. To fully collapse the surface 400', the panels 402 may be pivoted about the hinged connections 406, 408 so as to form an angle of zero degrees with each adjacent panel.

Although the present invention has been described in connection with various exemplary embodiments, those of ordinary skill in the art will understand that many modifications can be made thereto within the scope of the claims that follow. Accordingly, it is not intended that the scope of the invention in any way be limited by the above description, but instead be determined entirely be reference to the claims that follow.

What is claimed is:

1. A method of creating a dry erase structure, comprising:

providing a plurality of at least three panels;

providing a hinged connection between adjacent panels of the plurality, wherein at least one of the panels rotates around the hinged connection to form an angle less than 180 degrees with the back of the next adjacent panel and at least one of the panels rotates around the hinged connection to form an angle less than 180 degrees with the front of the next adjacent panel;

applying a dry erase film to at least one side of one or more of the plurality of panels;

providing a track; and attaching hangars to the plurality of at least three panels, wherein the hangars moveably engage the track and wherein each panel may rotate around an axis extending perpendicular to the direction of movement of the hangars with respect to the track.

2. The method of claim 1, further comprising adapting the track to be hung from a ceiling surface.

3. The method of claim 2, wherein applying the dry erase film is done prior to attaching adjacent panels of the plurality together with the hinged connection.

4. The method of claim 2, wherein attaching hangars to the plurality of at least three panels is done prior to applying the dry erase film.

5. The method of claim 1, further comprising pivoting the panels at the hinged connections to form angles larger than 90 degrees between adjacent panels.

6. The method of claim 1, further comprising pivoting the panels at the hinged connections to form angles smaller than 90 degrees between adjacent panels.

7. The method of claim 1, wherein the dry erase film is an ethylene/tetrafluoroethylene copolymer film on a polyvinyl chloride sheet with a polyester cloth backing.

8. The method of claim 7, wherein applying the dry erase film comprises fixing the dry erase film to the panels with an adhesive.

9. The method of claim 1, wherein the panels are plastic and the hinged connection is integral to the plastic panels.

10. The method of claim 1, further comprising writing on the dry erase film with a marker.

11. A dry erase surface structure, comprising:

a plurality of at least three contiguous panels;

a hinged connection between each contiguous panel, wherein at least one of the panels rotates around the hinged connection to form an angle less than 180 degrees with the back of the next adjacent panel and at least one of the panels rotates around the hinged connection to form an angle less than 180 degrees with the front of the next adjacent panel;

a dry erase film covering at least one side of one or more contiguous panels, wherein the dry erase film comprises an adhesive layer, a backing layer, a middle layer, and a top copolymer layer;

a track; and hangars connecting the plurality of at least three contiguous panels to the track, wherein each hangar is attached to a panel and moveably engages the track, and wherein each panel may rotate relative to the track around an axis parallel with the axis of the hinged connection.

12. The dry erase structure of claim 11, wherein the panels are plastic and the hinged connection is integral to the panels.

13. The dry erase structure of claim 11, wherein the dry erase film backing layer is polyester cloth, the dry erase film middle layer is a polyvinyl chloride sheet, and the dry erase film top copolymer layer is ethylene/tetrafluoroethylene film.

14. The dry erase structure of claim 11, wherein the panels are pivoted at the hinged connection such that adjacent panels form angles less than 90 degrees.

15. The dry erase structure of claim 11, wherein the panels are pivoted at the hinged connection such that adjacent panels form angles greater than 90 degrees.

16. The dry erase structure of claim 11, further comprising dry erase ink written on the dry erase film.

17. The dry erase structure of claim 11, wherein the track is adapted to be ceiling mounted.

18. A collapsible wall, comprising:

a plurality of contiguous panels;

a hinged connection between each contiguous panel;

a dry erase film covering at least one side of one or more contiguous panels, wherein the dry erase film comprises an adhesive layer, a backing layer, a middle layer, and a top copolymer layer;

ink written on the dry erase film;

a track; and hangars connecting the plurality of contiguous panels to the track, wherein each hangar is attached to a panel and moveably engages the track, and wherein each panel may rotate around an axis extending from a hangar downward.

19. The collapsible wall of claim 18, wherein the dry erase film backing layer is polyester cloth, the dry erase film middle layer is a polyvinyl chloride sheet, and the dry erase film top copolymer layer is ethylene/tetrafluoroethylene film.

20. The collapsible wall of claim 18, wherein the plurality of panels is adapted to be attached to a guide structure movably engaging the panels with the track.

21. The collapsible wall of claim 18, wherein the track is adapted to be ceiling mounted.

22. A dry erase structure, comprising:

a plurality of contiguous panels;

a hinged connection between each contiguous panel; and a dry erase film covering both sides of one or more contiguous panels;

a track; and hangars connecting the plurality of contiguous panels to the track, wherein each hangar is attached to a panel and moveably engages the track, and wherein each panel may rotate relative to the track around an axis extending parallel with the axis of the hinged connection.

23. The dry erase structure of claim 22, wherein the track is adapted to be ceiling mounted.

24. The dry erase structure of claim 22, further comprising:

an adhesive between the dry erase film and the one or more contiguous panels.

25. The dry erase structure of claim 22, wherein the panels are plastic and the hinged connection is integral to the panels.

26. The dry erase structure of claim 22, wherein the dry erase film is an ethylene-tetrafluoroethylene copolymer film on a polyvinyl chloride sheet with a polyester cloth backing.

27. The dry erase structure of claim 22, wherein the panels are pivoted at the hinged connection such that adjacent panels form angles less than 90 degrees.

28. The dry erase structure of claim 22, wherein the panels are pivoted at the hinged connection such that adjacent panels form angles greater than 90 degrees.

29. The dry erase structure of claim 22, further comprising dry erase ink written on the dry erase film.

* * * * *

UNITED STATES PATENT AND TRADEMARK OFFICE

CERTIFICATE OF CORRECTION

PATENT NO. : 6,648,051 B1
DATED : November 18, 2003
INVENTOR(S) : Young

It is certified that error appears in the above-identified patent and that said Letters Patent is hereby corrected as shown below:

Title page,
Item [56], References Cited, OTHER PUBLICATIONS, "My Whiteboards.com" reference, "Wallpapaer" should read -- Wallpaper --

Column 3,
Line 62, "A dry erase surface structure," should read -- A dry erase structure, --

Column 4,
Line 60, "contiguous panel; and" should read -- contiguous panel; --

Signed and Sealed this

Fifteenth Day of June, 2004

JON W. DUDAS
*Acting Director of the United States Patent and Trademark Office*